US006369776B1

(12) United States Patent
Leisten et al.

(10) Patent No.: US 6,369,776 B1
(45) Date of Patent: Apr. 9, 2002

(54) ANTENNA

(75) Inventors: Oliver Paul Leisten, Kingsthorpe; John Costas Vardaxoglou, Loughborough, both of (GB)

(73) Assignee: Sarantel Limited, Wellingborough (GB)

( * ) Notice: Subject to any disclaimer, the term of this patent is extended or adjusted under 35 U.S.C. 154(b) by 0 days.

(21) Appl. No.: 09/408,019

(22) Filed: Sep. 29, 1999

(30) Foreign Application Priority Data

Feb. 8, 1999 (GB) ..... 9902765

(51) Int. Cl.[7] ..... H01Q 1/36
(52) U.S. Cl. ..... 343/895; 343/821
(58) Field of Search ..... 343/895, 702, 343/873, 859, 821

(56) References Cited

U.S. PATENT DOCUMENTS

| | | | |
|---|---|---|---|
| 2,575,377 | A | 11/1951 | Wohl |
| 2,763,003 | A | 9/1956 | Harris |
| 3,611,198 | A | 10/1971 | Ma |
| 3,633,210 | A | 1/1972 | Westerman |
| 3,906,509 | A | 9/1975 | DuHamel |
| 3,940,772 | A | 2/1976 | Ben-dov |
| 4,008,478 | A | 2/1977 | Ikarath et al. |
| 4,008,479 | A | 2/1977 | Smith |
| 4,114,164 | A | 9/1978 | Greiser |
| 4,148,030 | A | 4/1979 | Foldes |
| 4,160,979 | A | 7/1979 | Drewett |
| 4,168,479 | A | 9/1979 | Rubin |
| 4,204,212 | A | 5/1980 | Sindoris et al. |
| 4,270,128 | A | 5/1981 | Drewett |

(List continued on next page.)

FOREIGN PATENT DOCUMENTS

| | | | |
|---|---|---|---|
| DE | 3217437 | A1 | 11/1983 |
| EP | 0 051 018 | B1 | 7/1985 |
| EP | 0 198 578 | A1 | 10/1986 |
| EP | 0 241 921 | A1 | 10/1987 |
| EP | 0 320 404 | B1 | 6/1989 |
| EP | 0 332 139 | A3 | 9/1989 |
| EP | 0 429 255 | A2 | 5/1991 |
| EP | 0 465 658 | A1 | 1/1992 |
| EP | 0 469 741 | A1 | 2/1992 |
| EP | 0 521 511 | A2 | 1/1993 |
| EP | 0 588 271 | A1 | 3/1994 |
| EP | 0 588 465 | A1 | 3/1994 |
| EP | 0 590 534 | A1 | 4/1994 |
| EP | 0 652 645 | A1 | 5/1995 |

(List continued on next page.)

OTHER PUBLICATIONS

Nakano, H., "Helical and Spiral Antennas—A Numerical Approach", Research Studies Press Ltd., England, pp. 1–261 (1987).

Krall et al., *IEEE Transactions on Antennas and Propagation,* vol. AP–27, No. 6, Nov. 1979, pp. 850–853.

Casey, J. et al., "Square Helical Antenna with a Dielectric Core", *IEEE Transactions on Electromagnetic Compatibility,* vol. 30, No. 4, Nov. 1988, pp. 429–436.

Espaignol, J. et al., "Duplexeur A Resonateurs Dielectriques En Bande K", *6es Journees Nationales Microondes,* Montpellier, Jun. 21–23, 1989, Centre D'Electronique De Montpellier, pp. 321–322.

International Search Report dated Feb. 5, 2000.

*Primary Examiner*—Michael C. Wilmer
*Assistant Examiner*—Ephrem Alemu
(74) *Attorney, Agent, or Firm*—Fulbright & Jaworski, LLP

(57) ABSTRACT

A UHF antenna has an electrically insulative cylindrical core of a solid material having a relative dielectric constant greater than 5, and a three-dimensional antenna element structure disposed on or adjacent the outer cylindrical surface of the core. The antenna element structure is coupled to a coaxial feeder passing axially through the core. To reduce the effect of unwanted resonant modes associated with the resonant length of the feeder inside the core, the core is spaced from the outer conductor of the feeder by an intervening layer of insulative material having a relative dielectric constant which is much lower that that of the core material.

25 Claims, 1 Drawing Sheet

U.S. PATENT DOCUMENTS 4,323,900 A 4/1982 Krall et al.
4,329,689 A 5/1982 Yee
4,349,824 A 9/1982 Harris
4,442,438 A 4/1984 Siwiak et al.
4,608,572 A 8/1986 Blakney et al.
4,608,574 A 8/1986 Webster et al.
4,697,192 A 9/1987 Hofer et al.
4,706,049 A 11/1987 Dydyk
4,862,184 A 8/1989 Ploussios
4,902,992 A 2/1990 Rubin et al.
4,910,481 A 3/1990 Sasaki et al.
4,940,992 A 7/1990 Nguyen et al.
4,980,694 A 12/1990 Hines
5,019,829 A 5/1991 Heckman et al.
5,023,866 A 6/1991 De Muro
5,055,852 A 10/1991 Dusseux et al.
5,081,469 A 1/1992 Bones
5,099,249 A 3/1992 Seavey
5,134,422 A 7/1992 Auriol
5,170,176 A 12/1992 Yasunaga et al.
5,170,493 A 12/1992 Roth
5,191,351 A 3/1993 Hofer et al. ..... 343/895
5,255,005 A 10/1993 Terret et al.
5,258,728 A 11/1993 Taniyoshi et al.
5,281,934 A 1/1994 Shiau et al.
5,298,910 A 3/1994 Takei et al.
5,329,287 A 7/1994 Strickland
5,341,149 A 8/1994 Valimaa et al.
5,345,248 A 9/1994 Hwang et al.
5,346,300 A 9/1994 Yamamoto et al.
5,349,361 A 9/1994 Egashira et al.
5,349,365 A 9/1994 Ow et al.
5,358,515 A 10/1994 Hurter et al. ..... 607/101
5,406,296 A 4/1995 Egashira et al.
5,406,693 A 4/1995 Egashira et al.
5,450,093 A 9/1995 Kim
5,479,180 A 12/1995 Lenzing et al.
5,541,613 A 7/1996 Lam et al.
5,548,255 A 8/1996 Spielman
5,612,707 A 3/1997 Vaughan et al.
5,748,154 A 5/1998 Yokota
5,854,608 A 12/1998 Leisten
5,859,621 A 1/1999 Leisten
5,945,963 A 8/1999 Leisten
5,963,180 A 10/1999 Leisten

FOREIGN PATENT DOCUMENTS

EP 0 777 293 A1 6/1997
EP 0 791 978 A2 8/1997
EP 805513 11/1997
FR 2570546 A1 3/1986
FR 2603743 3/1988
GB 762415 11/1956
GB 840850 7/1960
GB 1198410 7/1970
GB 1568436 5/1980
GB 2196483 B 4/1988
GB 2 202 380 A 9/1988
GB 2 243 724 B 11/1991
GB 2 246 910 A 2/1992
GB 2 248 344 B 4/1992
GB 2 292 257 A 2/1996
GB 2 292 638 A 2/1996
GB 2 309 592 A 7/1997
GB 2 310 543 A 8/1997
GB 2 311 675 A 10/1997
GB 2 317 057 A 3/1998
GB 2 321 785 A 8/1998
GB 2 326 532 A 12/1998
JP 3-274904 12/1991
JP 7-249973 9/1995
JP 8-8408 1/1996
SU 1483-511 5/1989
WO WO 91/11038 7/1991
WO WO 92/05602 4/1992
WO WO 92/17915 10/1992
WO WO 93/22804 11/1993
WO WO 94/21001 9/1994
WO WO 94/27338 11/1994
WO WO 96/06468 2/1996
WO WO 97/27642 7/1997
WO WO 98/24144 6/1998

ANTENNA

FIELD OF THE INVENTION

This invention relates to an antenna for operation at frequencies in excess of 200 MHz, and particularly but not exclusively to an antenna having helical elements on or adjacent the surface of a solid dielectric core.

BACKGROUND OF THE INVENTION

Such an antenna is disclosed in our co-pending British Patent Applications Nos. 2292638A, 2309592A and 2310543A, the entire disclosures of which are incorporated in this present application-so as to form part of the subject matter of this application as first filed. The earlier applications disclose antennas each having one or two pairs of diametrically opposed helical antenna elements which are plated on a substantially cylindrical electrically insulative core of a material having a relative dielectric constant greater than 5, with the material of the core occupying the major part of the volume defined by the core outer surface. A feeder structure extends axially through the core, and a trap in the form of a conductive sleeve encircles part of the core and connects to the feeder at one end of the core. At the other end of the core the antenna elements are each connected to the feeder structure. Each of the antenna elements terminates on a rim of the sleeve, each following a respective longitudinally extending path.

Such antennas can be used for the reception of circularly polarised signals, including signals transmitted by satellites of the Global Positioning System (GPS) which are transmitted at 1575 MHz. The antennas also have applications in the field of portable telephones, e.g. cellular telephones operating in UHF telephone bands, as described in the above-mentioned published applications. The applicants have determined that, at certain frequencies of interest, the feeder structure within the ceramic core can exhibit its own resonance which, if close to the required frequency of the antenna, can decrease antenna efficiency.

SUMMARY OF THE INVENTION

To overcome this difficulty, the present invention provides an antenna in which the feeder structure is spaced from the material of the solid dielectric core. In particular, the feeder structure is a coaxial transmission line provided with an outer sheath of dielectric material having a relative dielectric constant which is much lower than that of the core. In this way, the electrical length of, for instance, the outer conductor of a coaxial feeder structure is altered by virtue of being spaced from the high dielectric material of the core so that its resonant frequency is shifted with respect to the required operating frequency of the antenna to avoid coupling with the required resonant mode, thereby to increase antenna efficiency. Providing the thickness of the sheath is relatively small compared with the radial thickness of the core, i.e. between the outer surface of the sheath and the outer surface of the core, the required resonance due to the antenna elements on or adjacent the outer surface of the core is comparatively unaffected.

DETAILED DESCRIPTION OF A PREFERRED EMBODIMENT OF THE INVENTION

Figure 1:
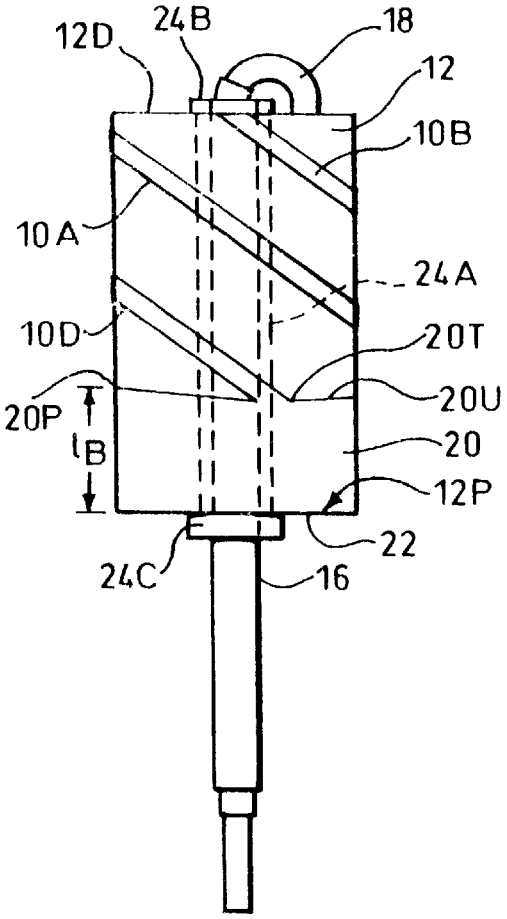
FIG. 1 is a side elevation of an exemplary antenna in accordance with the invention.
Figure 2:
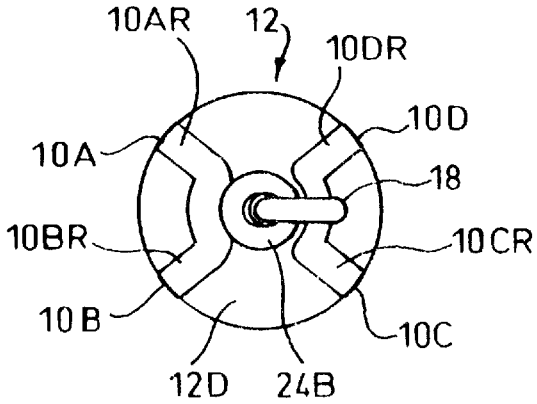
FIG. 2 is a plan view of the antenna.
Figure 3:
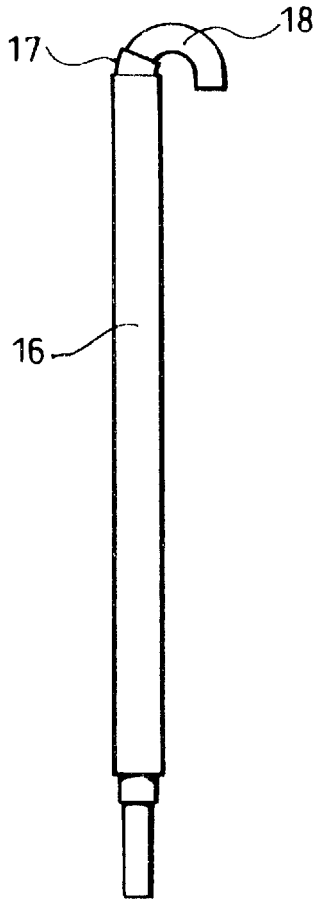
FIG. 3 is a side elevation of a feeder structure of the antenna of FIGS. 1 and 2.
Figure 4:
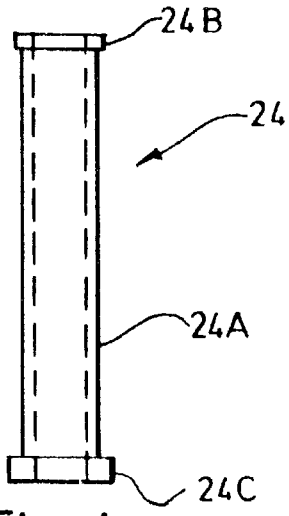
FIG. 4 is a side elevation of a plastics sheath to act as a separating layer between the feeder structure and the core material of the antenna.

Referring to the drawings, a quadrifilar antenna in accordance with the invention has an antenna element structure with four longitudinally extending antenna elements 10A, 10B, 10C, and 10D formed as metallic conductor tracks on the cylindrical outer surface of a ceramic core 12. The core has an axial passage and the passage houses a coaxial feeder having an outer conductor 16, an inner dielectric insulating material 17 and an inner conductor 18. The inner and outer conductors 18 and 16, and insulating material 17 in this case form a feeder structure for connecting a feed line to the antenna elements 10A–10D. The antenna element structure also includes corresponding radial antenna elements 10AR, 10BR, 10CR, 10DR formed as metallic tracks on a distal end face 12D of the core 12 connecting ends of the respective longitudinally extending elements 10A–10D to the feeder structure. The other ends of the antenna elements 10A–10D are connected to a common virtual ground conductor 20 in the form of a plated sleeve surrounding a proximal end portion of the core 12. This sleeve 20 is in turn connected to the outer conductor 16 of the feeder structure in a manner described below.

As will be seen from FIG. 1, the four longitudinally extending elements 10A–10D are different lengths, two of the elements 10B, 10D being longer than the other two 10A, 10C by virtue of extending nearer the proximal end of the core 12. The elements of each pair 10A, 10C; 10B, 10D are diametrically opposite each other on opposite sides of the core axis.

In order to maintain approximately uniform radiation resistance for the helical elements 10A–10D, each element follows a simple helical path. Since each of the elements 10A–10D subtends the same angle of rotation at the core axis, here 180° or a half turn, the screw pitch of the long elements 10B, 10D is steeper than that of the short elements 10A, 10C. The upper rim or linking edge 20U of the sleeve 20 is of varying height (i.e. varying distance from the proximal end face 12P) to provide points of connection for the long and short elements respectively. Thus, in this embodiment, the linking edge 20U follows a zig-zag path around the core 12, having two peaks 20P and two troughs 20T where it meets the short elements 10A, 10C and long elements 10B, 10D respectively.

Each pair of longitudinally extending and corresponding radial elements (for example 10A, 10AR) constitutes a conductor having a predetermined electrical length. In the present embodiment, it is arranged that the total length of each of the element pairs 10A, 10AR; 10C, 10CR having a shorter length corresponds to a transmission delay of approximately 135° at the operating wavelength, whereas each of the elements pairs 10B, 10BR; 10D, 10DR produce a longer delay, corresponding to substantially 225°. Thus, the average transmission delay is 180°, equivalent to an electrical path of $\lambda/2$ at the operating wavelength. The differing lengths produce the required phase shift conditions for a quadrifilar helix antenna for circularly polarised signals specified in Kilgus, "Resonant Quadrifilar Helix Design", the Microwave Journal, December 1970, pages 49–54. Two of the element pairs 10C, 10CR; 10D, 10DR (i.e. one long element pair and one short element pair) are connected at the inner ends of the radial elements 10CR, 10DR to the inner conductor 18 of the feeder structure at the distal end of the core 12, while the radial elements of the other two element pairs 10A, 10AR; 10B, 10BR are connected to the feeder screen formed by conductor 16. At the distal end of the feeder structure, the signals present on the inner and outer conductors 16, 18 are approximately balanced so that the antenna elements are connected to an approximately balanced source or load, as will be explained below.

With the left-handed sense of the helical paths of the longitudinally extending elements 10A–10D, the antenna has its highest gain for right-hand circularly polarised signals. If the antenna is to be used instead for left-hand circularly polarised signals, the direction of the helices is reversed and the pattern of connection of the radial elements is rotated through 90°. In the case of an antenna suitable for receiving both left-hand and right-hand circularly polarised signals, the longitudinally extending elements can be arranged to follow paths which are generally parallel to the axis.

The conductive sleeve 20 covers a proximal portion of the antenna core 12, thereby surrounding the feeder structure 16, 18 with the material of the core 12 filling the major part of the space between the sleeve 20 and the feeder structure outer conductor 16. The sleeve 20 forms a cylinder having an average axial length $l_B$ as shown in FIG. 1 and is connected to the outer conductor 16. The combination of the sleeve 20 and plating 22 forms a balun so that signals in the transmission line formed by the feeder structure 16, 18 are converted between an unbalanced state at the proximal end of the antenna and an approximately balanced state at an axial position generally at the same distance from the proximal end as at the upper linking edge 20U of the sleeve 20. To achieve this effect, the average sleeve length $l_B$ is such that, in the presence of the underlying core material of relatively high relative dielectric constant, the balun has an average electrical length of $\lambda/4$ at the operating frequency of the antenna. Since the core material of the antenna has a foreshortening effect, and the annular space surrounding the inner conductor 18 is filled with an insulating dielectric material 17 having a relatively small dielectric constant, the feeder structure distally of the sleeve 20 has a short electrical length. Consequently, signals at the distal end of the feeder structure 16, 18 are at least approximately balanced. (The dielectric constant of the insulation in a semi-rigid cable is typically much lower than that of the ceramic core material referred to above. For example, the relative dielectric constant $\epsilon_r$ of PTFE is about 2.2.)

The applicants have found that the variation in length of the sleeve 20 from the mean electrical length of $\lambda/4$ has a comparatively insignificant effect on the performance of the antenna. The trap formed by the sleeve 20 provides an annular path along the linking edge 20U for currents between the elements 10A–10D, effectively forming two loops, the first with short elements 10A, 10C and the second with the long elements 10B, 10D. At quadrifilar resonance current maxima exist at the ends of the elements 10A–10D and in the linking edge 20U, and voltage maxima at a level approximately midway between the edge 20U and the distal end of the antenna. The edge 20U is effectively isolated from the ground connector at its proximal edge due to the approximate quarter wavelength trap produced by the sleeve 20.

To reduce the effect of the ceramic core material on the electrical length (and hence the resonant frequency) of the outer conductor 16 of the feeder structure within the core 12, a tubular plastics sheath 24 is placed around the feeder structure 16, 18. The outer diameter of the sheath 24 matches the inner diameter of the ceramic core 12, and the inner diameter of the sheath 24 matches the outer diameter of the outer conductor 16 so that air is substantially excluded from the space between the core 12 and the feeder structure 16, 18. The sheath may be a single moulded component with a central tubular section 24A, and upper and lower flanges 24B, 24C for overlapping the distal and proximal end faces 12D, 12P by a small degree. These end flanges are plated with conductive material to allow a soldered or alternative conductive connection between, at the distal end, the outer conductor 16 and radial elements 10AR, 10BR and, at the proximal end, between the outer conductor 16 and the plated end face 22 of the core.

The sheath is made of a material having a relative dielectric constant which is less than half that of the core material and is typically of the order of 2 or 3. The material falls within a class of thermoplastics capable of resisting soldering temperatures as well as being suitable, when moulded, to have its surface catalysed to accept electroplating. The material should also have sufficiently low viscosity during moulding to form a tube with a wall thickness in the region of 0.5 mm. One such material is PEI (polyetherimide). This material is available from Dupont under the trademark Ultem. Polycarbonate is an alternative material.

The preferred wall thickness of the tubular section 24A of the sheath 24 is 0.45 mms, but other thicknesses may be used, depending on such factors as the diameter of the ceramic core 12 and the limitations of the moulding process. In order than the ceramic core has a significant effect on the electrical characteristics of the antenna, and particularly yields an antenna of sufficiently small size, the wall thickness of the sheath 24 should be no greater than the thickness of the solid core 12 between its inner passage and its outer surface. Indeed, the sheath wall thickness should be less than one half the core thickness, preferably less than 20% of the core thickness. In this preferred embodiment, the wall thickness of the sheath is 0.5 mm while the thickness of the core is approximately 3.5 mm.

To ease production, the sheath may be constructed so as to have three sections, i.e. a central tubular section of constant cross-section, and end grommets which abut the ends of the central section, the grommets being plated at least on their surfaces which are exposed when the sheath is mounted within the core 12 to effect the afore-mentioned electrical connections.

As explained above, by creating a region surrounding the outer conductor 16 of the feeder structure 16, 18 of lower dielectric constant than the dielectric constant of the core 12, the effect of the core 12 on the electrical length of the outer conductor 16 and, therefore, on any longitudinal resonance associated with the outside of the conductor 16, is substantially diminished. The close fitting sheath 24 described above ensures consistency and stability of tuning. Since the mode of resonance associated with the required operating frequency is characterised by voltage dipoles extending diametrically, i.e. transversely of the core axis, the effect of the low dielectric constant sheath 24 on the required mode of resonance is relatively small due to the sheath thickness being, at least in the preferred embodiment, considerably less than that of the core. It is, therefore, possible to cause the linear mode of resonance associated with the feeder outer conductor 16 to be de-coupled from the wanted mode of resonance.

The antenna has a main resonant frequency of 500 MHz or greater, the resonant frequency being determined by the effective electrical lengths of the antenna elements and, to a lesser degree, by their width. The lengths of the elements, for a given frequency of resonance, are also dependent on the relative dielectric constant of the core material, the dimensions of the antenna being substantially reduced compared with those of an air-cored antenna of similar geometry.

The preferred material of the core 12 is a zirconium-tin-titanate-based material. This material has the above-mentioned relative dielectric constant of 36 and is noted also for its dimensional and electrical stability with varying temperature. Dielectric loss is negligible. The core may be produced by extrusion or pressing.

The antenna elements 10A–10D, 10AR–10DR are metallic conductor tracks bonded to the outer cylindrical and end surfaces of the core 12, each track being of a width at least four times its thickness over its operative length. The tracks may be formed by initially plating the surfaces of the core 12 with a metallic layer and then selectively etching away the layer to expose the core according to a pattern applied in a photographic layer similar to that used for etching printed circuit boards. Alternatively, the metallic material may be applied by selective deposition or by printing techniques. In all cases, the formation of the tracks as an integral layer on the outside of a dimensionally stable core leads to an antenna having dimensionally stable antenna elements.

With a core material having a substantially higher relative dielectric constant than that of air, e.g. $\epsilon_r$=36, an antenna as described above for L-band GPS reception at 1575 MHz typically has a core diameter of about 10 mm and the longitudinally extending antenna elements 10A–10D have an average longitudinal extent (i.e. parallel to the central axis) of about 12 mm. At 1575 MHz, the length of the sleeve 20 is typically in the region of 5 mm. Precise dimensions of the antenna elements 10A–10D can be determined in the design stage on a trial and error basis by undertaking eigenvalue delay measurements until the required phase difference is obtained. The diameter of the feeder structure is in the region of 2 mm.

The manner in which the antenna is manufactured is described in the above-mentioned Application No. 2292638A.

What is claimed is:

1. An antenna for operation at a frequency in excess of 200 MHz, comprising an electrically insulative antenna core of a solid material having a relative dielectric constant greater than 5, a three-dimensional antenna element structure disposed on or adjacent the outer surface of the core and defining an interior volume, and a feeder structure which is connected to the element structure and passes through the core, wherein the feeder structure i) includes an outer conductor, an inner dielectric insulating material and an inner conductor; ii) is housed in a passage through the core; iii) and is spaced from the passage wall by a dielectric layer having a relative dielectric constant which is less than half of the relative dielectric constant of the solid material of the core.

2. An antenna according to claim 1 wherein the feeder structure is spaced from the passage wall by a tube made of plastics material.

3. An antenna according to claim 2, wherein the tube extends over the whole length of the feeder structure within the core.

4. An antenna according to claim 1, wherein the thickness of the layer is less than the thickness of the core between the passage wall and said outer surface.

5. An antenna according to claim 4, wherein the thickness of the layer is less than 20% of said core thickness.

6. An antenna according to claim 2, wherein the tube material is a high temperature thermoplastics material.

7. An antenna according to claim 2, wherein the tube has exposed end portions which are plated to form electrical connections between the feeder structure and conductive elements on the core.

8. An antenna according to claim 1, wherein the antenna element structure comprises a plurality of antenna elements defining an envelope centred on a central axis of the antenna, and wherein the feeder structure is coincident with said axis.

9. An antenna according to claim 8, wherein the core is a cylinder and the antenna elements define a cylindrical envelope which is coaxial with the core.

10. An antenna according to claim 8, wherein the core is a cylindrical body which is solid with the exception of an axial passage housing the feeder structure.

11. An antenna according to claim 10, wherein the volume of the solid material of the core is at least 50 percent of the internal volume of the envelope defined by the elements, with the elements lying on an outer cylindrical surface of the core.

12. An antenna according to claim 8, wherein the elements comprise metallic conductor tracks bonded to the core outer surface.

13. An antenna according to claim 1, wherein the material of the core is a ceramic.

14. An antenna according to claim 13, wherein the relative dielectric constant of the material is greater than 10.

15. An antenna according to claim 1, having a cylindrical core of solid material with an axial extent at least as great as its outer diameter, and with the diametrical extent of the solid material being at least 50 percent of the outer diameter.

16. An antenna according to claim 15, wherein the core is in the form of a tube having an axial passage of a diameter less than a half of its overall diameter.

17. An antenna according to claim 15, wherein the antenna element structure comprises a plurality of generally helical antenna elements formed as metallic tracks on the outer surface of the core which are generally co-extensive in the axial direction.

18. An antenna according to claim 17, wherein each helical element is connected to the feeder structure at one of its ends and to at least one of the other helical elements at its other end.

19. An antenna according to claim 18, wherein the connections to the feeder structure are made with generally radial conductive elements, and each helical element is connected to one of a ground and a virtual ground conductor, which conductor is common to all of the elements.

20. An antenna according to claim 19, wherein the core has a constant external cross-section in the axial direction, with the antenna elements being conductors plated on the surface of the core.

21. An antenna according to claim 1, including an integral balun formed by a conductive sleeve extending over part of the length of the core from a connection with the feeder structure at said opposite end of the core.

22. An antenna according to claim 21, wherein the balun sleeve forms the common conductor for the longitudinally extending conductor elements, and the conductive sleeve of the balun being connected at said opposite end of the core to the feeder structure outer screen conductor.

23. An antenna according to claim 20, wherein the core is a cylinder, and wherein the antenna elements comprise at least four longitudinally extending elements on the cylindrical outer surface of the core and corresponding radial elements on a distal end face of the core connecting the longitudinally extending elements to the conductors of the feeder structure.

24. An antenna according to claim 23, wherein the longitudinally extending elements are of different lengths.

25. An antenna according to claim 24, wherein the antenna elements comprise four longitudinally extending elements, two of which are of greater length than the other two.

* * * * *